US009912108B2

(12) United States Patent
Mito

(10) Patent No.: US 9,912,108 B2
(45) Date of Patent: Mar. 6, 2018

(54) ELECTRICAL CONNECTOR

(71) Applicant: Tyco Electronics Japan G.K., Kanagawa (JP)

(72) Inventor: Yusuke Mito, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 15/181,830

(22) Filed: Jun. 14, 2016

(65) Prior Publication Data

US 2016/0365681 A1 Dec. 15, 2016

(30) Foreign Application Priority Data

Jun. 15, 2015 (JP) ..... 2015-119959

(51) Int. Cl.
*H01R 13/73* (2006.01)
*H01R 12/70* (2011.01)

(52) U.S. Cl.
CPC ..... *H01R 13/73* (2013.01); *H01R 12/7047* (2013.01)

(58) Field of Classification Search
CPC .. H01R 13/73; H01R 12/7047; H01R 13/631; H01R 13/512
See application file for complete search history.

(56) References Cited

U.S. PATENT DOCUMENTS 4,173,387 A * 11/1979 Zell ..... H01R 12/7029 439/557
6,162,091 A * 12/2000 Kurotori ..... H01R 43/0256 439/567
6,824,424 B2 * 11/2004 Hattori ..... H05K 3/306 439/567
6,859,367 B2 * 2/2005 Davison ..... H01L 23/4006 165/185
7,182,610 B2 * 2/2007 Lin ..... H01R 12/707 439/567

FOREIGN PATENT DOCUMENTS

JP 7272782 A 10/1995
JP 2003257563 A 9/2003

* cited by examiner

*Primary Examiner* — Xuong Chung Trans
(74) *Attorney, Agent, or Firm* — Barley Snyder

(57) ABSTRACT

An electrical connector is disclosed. The electrical connector comprises a housing and an attachment block disposed on the housing. The attachment block has a first end, an opposite second end, a first truncated conical portion having an outer radius continuously increasing from the first end toward the second end, and a second truncated conical portion having an outer radius continuously increasing from the second end toward the first end.

14 Claims, 7 Drawing Sheets

ELECTRICAL CONNECTOR

CROSS-REFERENCE TO RELATED APPLICATIONS

This application claims the benefit of the filing date under 35 U.S.C. § 119 (a)-(d) of Japanese Patent Application No. 2015-119959 filed Jun. 15, 2015.

FIELD OF THE INVENTION

The present invention relates to an electrical connector, and more particularly, to an electrical connector having a means for alignment with a target of attachment.

BACKGROUND

Electrical connectors are often fixed for use to targets of attachment, such as holders, circuit boards, or other electrical devices, by fasteners such as screws. Japanese Patent Number H07-272782A, for example, discloses an attachment mechanism in which one side of an electrical connector (10) is screwed to a mechanical chassis (20), and an opposite side is soldered to a printed board (30). In JP H07-272782A, the electrical connector is screwed to the mechanical chassis by positioning long screws (17) through reinforcement projections (11a, 11b) formed integrally with the electrical connector.

In JP H07-272782A, since the screw must align with screw holes in both the electrical connector and the target of attachment, the position of the electrical connector relative to the target of attachment is fixed and pre-determined. The screws are commonly partially inserted into the connector before placing the connector on the target of attachment in order to simplify an attachment with proper alignment. However, in some applications, structural restrictions prevent preliminary insertion of the screw into the electrical connector. Positioning such an electrical connector accurately with respect to the target of attachment, for proper attachment, can be very difficult.

SUMMARY

An object of the invention, among others, is to provide an electrical connector capable of being located with high accuracy relative to a target of attachment. The disclosed electrical connector comprises a housing and an attachment block disposed on the housing. The attachment block has a first end, an opposite second end, a first truncated conical portion having an outer radius continuously increasing from the first end toward the second end, and a second truncated conical portion having an outer radius continuously increasing from the second end toward the first end.

BRIEF DESCRIPTION OF THE DRAWINGS

The invention will now be described by way of example with reference to the accompanying figures, of which:

FIG. 2(*b*) is a bottom exploded view of the electrical connector assembly of FIG. 1;

FIG. 3(*b*) is a front view of the electrical connector of FIG. 3(*a*);

FIG. 3(*c*) is a bottom view of the electrical connector of FIG. 3(*a*);

FIG. 4(*b*) is a sectional view of the attachment block of FIG. 4(*a*);

FIG. 4(*c*) is a bottom view of the attachment block of FIG. 4(*a*);

FIG. 5(*b*) is a sectional view of a second mold of the attachment block of FIG. 4(*a*);

FIG. 5(*c*) is a sectional view of a third mold of the attachment block of FIG. 4(*a*);

FIG. 5(*d*) is a sectional view of a mold of an attachment block according to another embodiment;

FIG. 7(*b*) is a sectional view of an attachment block according to another embodiment and the housing tower of FIG. 7(*a*); and FIG. 7(*c*) is a sectional view of an attachment block according to another embodiment and the housing tower of FIG. 7(*a*).

DETAILED DESCRIPTION OF THE EMBODIMENT(S)

The invention is explained in greater detail below with reference to embodiments of an electrical connector assembly. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
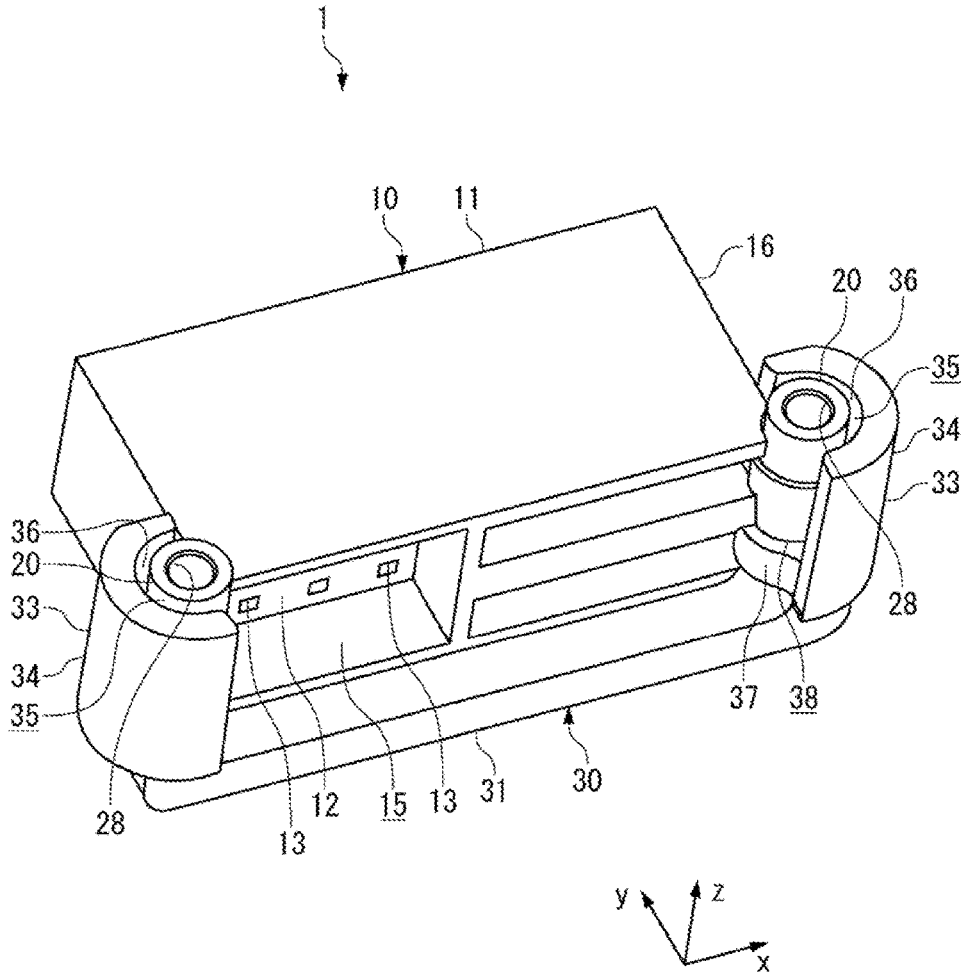
FIG. 1 is a perspective view of an electrical connector assembly according to the invention.

An electrical connector assembly 1 according to the invention is shown generally in FIG. 1. The electrical connector assembly 1 includes an electrical connector 10, a holder 30, and a screw 100. The major components of the invention will now be described in greater detail.

It should be noted that, in the shown embodiments, an x axis direction, a y axis direction, and a z axis direction in FIG. 1 are defined as a widthwise direction x, a rear-to-front direction y, and a height direction z, respectively. In addition, regarding the rear-to-front direction y, a side to which a mating connector is mated (a side indicated by the arrow of the y axis in FIG. 1) is defined as the front.

Figure 2A:
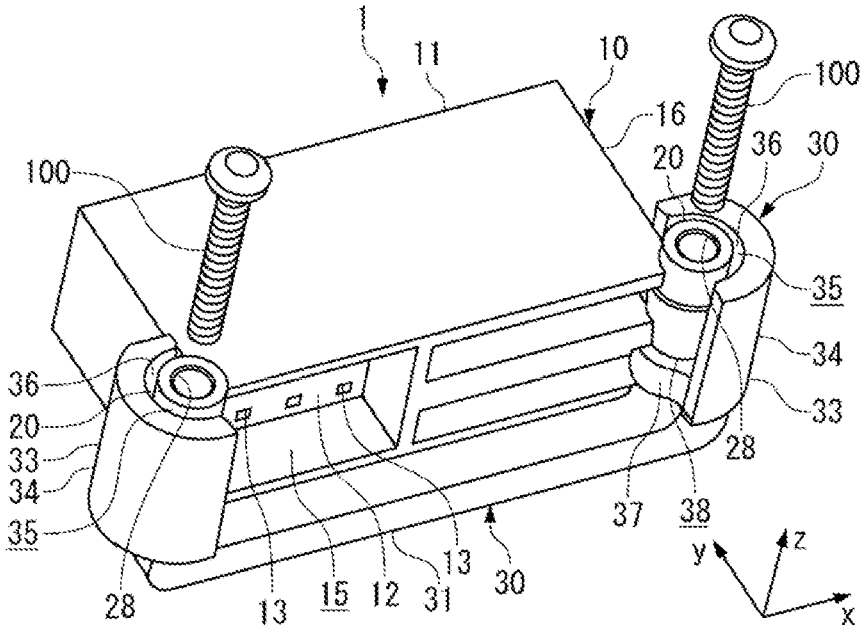
FIG. 2(*a*) is a top exploded view of the electrical connector assembly of FIG. 1.
Figure 2B:
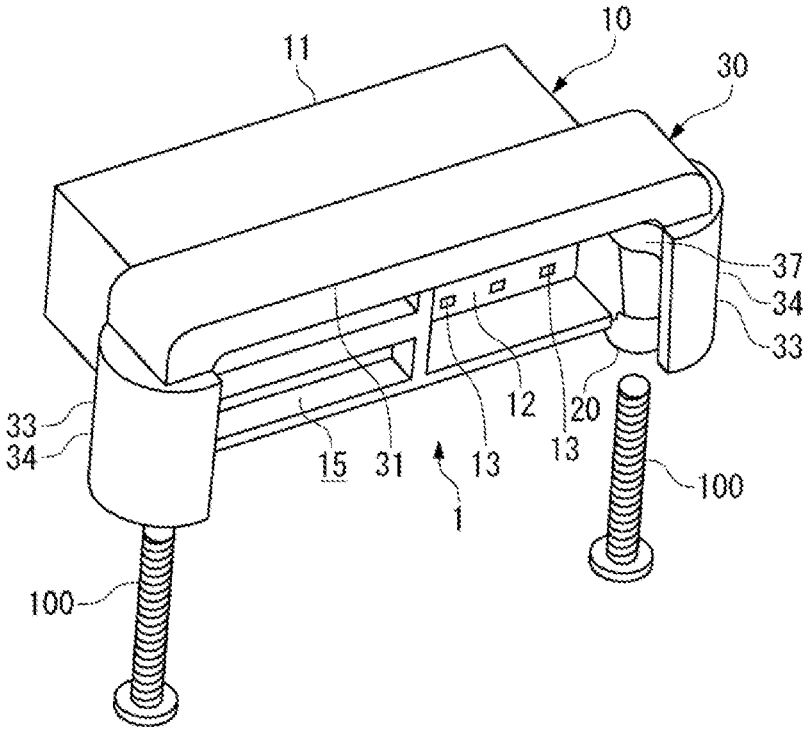
Figure 3A:
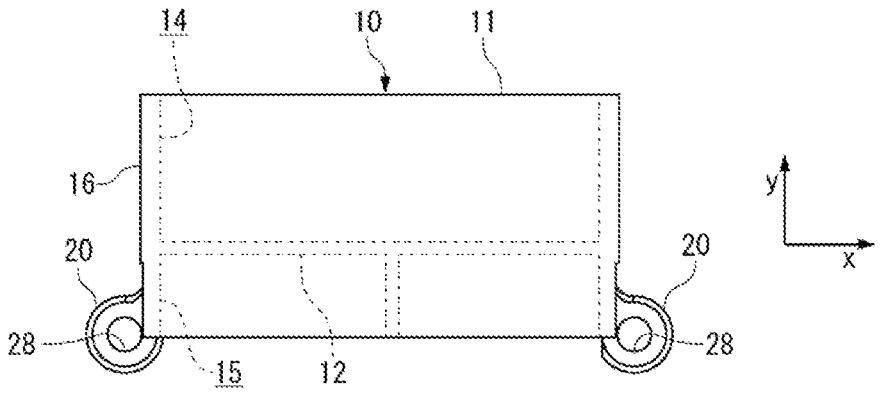
FIG. 3(*a*) is a plan view of an electrical connector of the electrical connector assembly of FIG. 1.
Figure 3B:
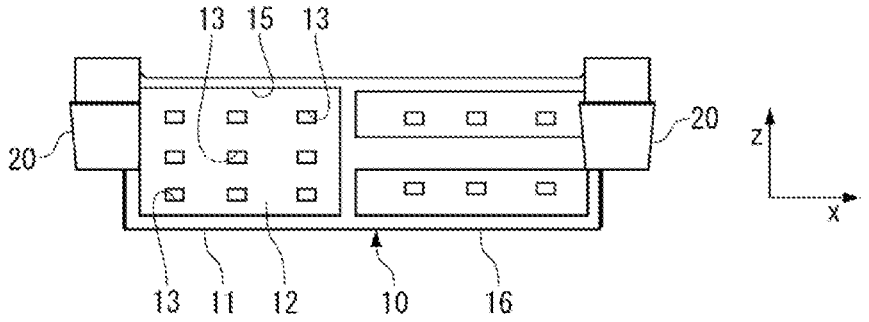
Figure 3C:
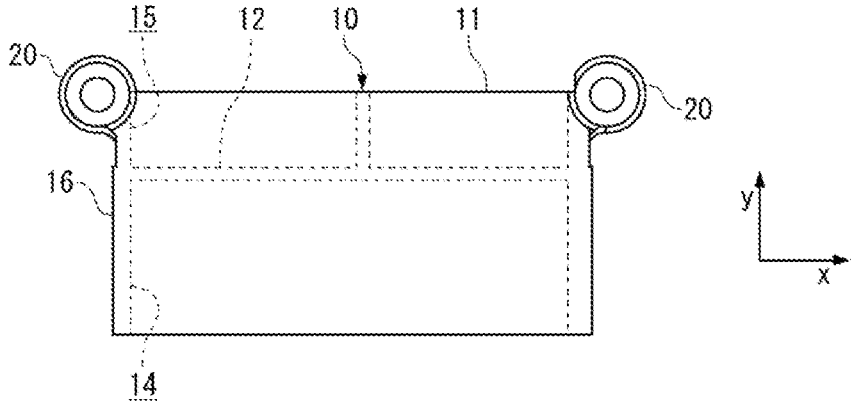

The electrical connector 10, as shown in FIGS. 1 to 3, includes a housing 11 holding a plurality of contacts (not shown) and a plurality of attachment blocks 20 provided on both sides of the housing 11 in the widthwise direction. In an embodiment, the housing 11 and the attachment blocks 20 are integrally formed by injection molding of electrically-insulating resin.

The housing 11, as shown in FIG. 3, is provided with a holding wall 12 holding the contacts, a mating recess 14 provided in front of the holding wall 12, and a lead-out recess 15 provided behind the holding wall 12. The holding wall 12, the fitting recess 14, and the lead-out recess 15 are enclosed within side walls 16. The holding wall 12 holds contacts (not shown) such that the contacts are press-fitted in holding holes 13 shown in FIG. 3(*b*). The contact held by the holding wall 12 has a first portion disposed in the mating recess 14 and an opposite second portion disposed in the lead-out recess 15.

Figure 4A:
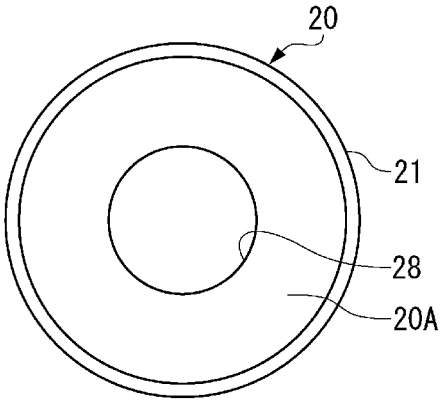
FIG. 4(*a*) is a plan view of an attachment block of the electrical connector of FIG. 3(*a*)
Figure 4B:
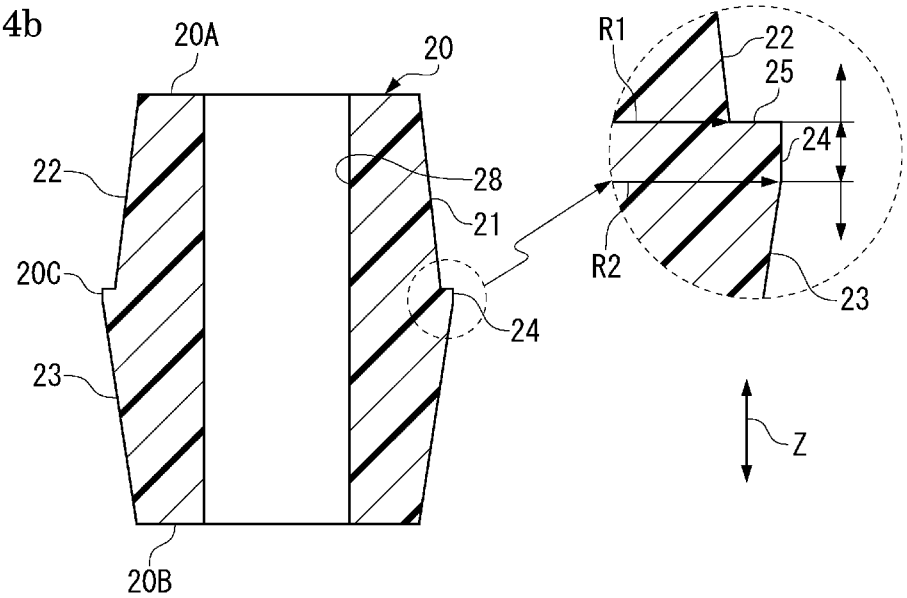
Figure 4C:
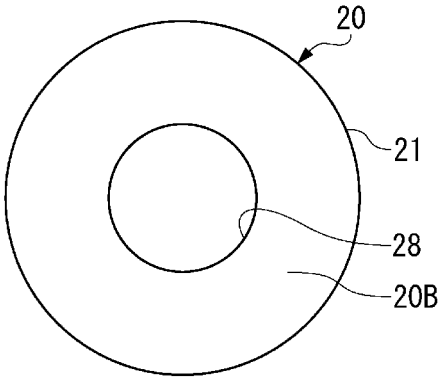
Figure 5A:
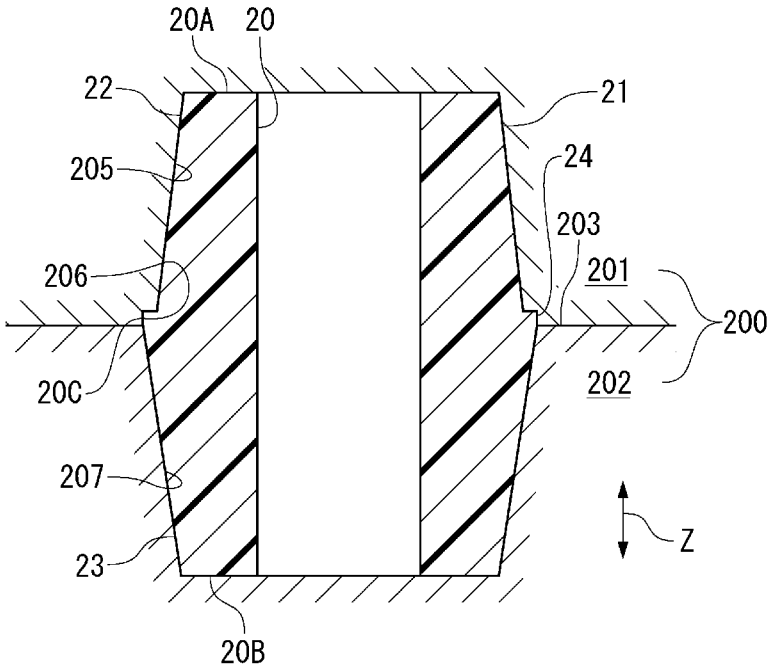
FIG. 5(*a*) is a sectional view of a first mold of the attachment block of FIG. 4(*a*)
Figure 5B:
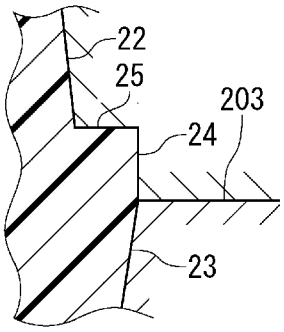
Figure 5C:
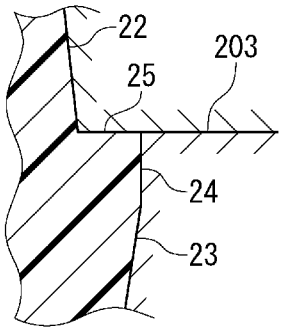
Figure 5D:
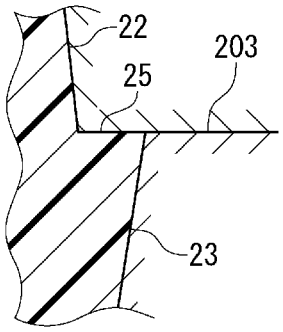

In the shown embodiment, a pair of attachment blocks 20 are disposed on the housing 11, one attachment block 20 is provided on each side in the widthwise direction x of the housing 11. The attachment block 20, as shown in FIGS. 3 and 4, may be formed in a cylindrical shape, excluding a portion connected with the side walls 16. A longitudinal axis of the attachment block 20 extends along the height direction z. The attachment block 20, as shown in FIG. 4, has one end 20A in the height direction z, the other end 20B in the height direction z, and a central portion 20C in the height direction z.

The attachment block 20, as shown in FIG. 4, includes a guide face 21 composed of an arc-like outer peripheral face, and an insertion hole 28 extending in the height direction z. In the shown embodiment, the insertion hole 28 is not threaded.

The attachment block 20 also includes a first truncated conical portion 22 having an outer radius increasing continuously from the end 20A toward the central portion 20C, and a second truncated conical portion 23 having an outer radius increasing continuously from the other end 20B toward the central portion 20C. The attachment block 20 has a substantially barrel appearance in which the respective larger outer radius sides of the first truncated conical portion 22 and the second truncated conical portion 23 abut each other.

A constant radius portion 24, as shown in FIG. 4(*b*), having a constant outer radius in the height direction z is formed between the first truncated conical portion 22 and the second truncated conical portion 23. In this regard, when a maximum radius of the first truncated conical portion 22 toward the central portion 20C is represented by R1, and a maximum radius of the second truncated conical portion 23 toward the central portion 20C is represented by R2 (where R1<R2), the constant radius portion 24 has an outer radius equal to R2, is continuous to a portion having the outer radius R2 of the second truncated conical portion 23, and is continuous to a portion having the outer radius R1 of the first truncated conical portion 22 via a step 25. In this manner, the guide face 21 has high visibility when seen in plan view from the one end 20A side since the region of the constant radius portion 24 projects most in the radial direction, and in addition a boundary portion between the step 25 and the constant radius portion 24 forms an edge.

For molding the attachment block 20, as shown in FIG. 5(*a*), a mold 200 provided with an upper mold 201 and a lower mold 202 parted in the height direction z is used. The mold 200, as shown in FIGS. 5(*a*) and 5(*b*), is provided with a mold parting plane 203 parting the upper molding 201 and the lower mold 202 at a position corresponding to a boundary between the constant radius portion 24 and the second truncated conical portion 23. The upper mold 201 has a molding face 205 corresponding to the guide face 21 of the first truncated conical portion 22, and a molding face 206 corresponding to the guide surface 21 of the constant radius portion 24. The molding face 205 has an inner radius increasing continuously from the end 20A toward the central portion 20C, and the molding face 206 has a constant inner radius in the height direction z. The lower mold 202 is provided with a molding face 207 corresponding to the guide surface 21 of the second truncated conical portion 23. The molding face 207 has an inner radius increasing continuously from the end 20B toward the central portion 20C. The molding face 205 forms a draft angle of the upper mold 201 relative to the first truncated conical portion 22, and the molding face 207 forms a draft angle of the lower mold 202 relative to the second truncated conical portion 23, so that the attachment block 20 is easily released from the mold 200.

Figure 6:
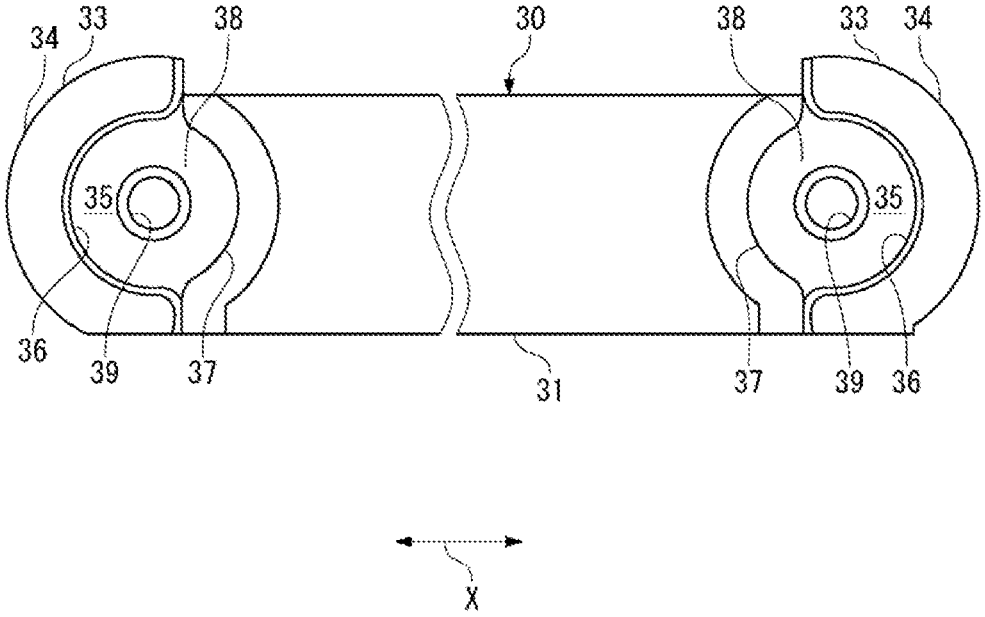
FIG. 6 is a plan view of a holder of the electrical connector of FIG. 3(*a*)

The holder 30, as shown in FIGS. 1 and 6, has a joining piece 31 and a pair of housing towers 33 provided on both sides of the joining piece 31 in the widthwise direction x. In the embodiment shown, the holder 30 is manufactured from a metal material, for example, aluminum alloy or the like, but can also be manufactured from resin.

The housing tower 33, as shown in FIG. 6, is provided with a tower main body 34 upstanding from the joining piece 31, a housing chamber 35 provided inside the tower main body 34, a guide face 36 facing the housing chamber 35 and formed inside the tower main body 34, and a support base 37 provided on a bottom portion of the housing chamber 35. It should be noted that the inside (outside) in this context is based on the widthwise direction x.

The tower main body 34, as shown in FIG. 1, extends vertically relative to the joining piece 31. The housing chamber 35 is defined outside by the guide face 36 of the tower main body 34, and opened inside. The guide face 36 forms an arc face having a central axis along the height direction z, and the housing chamber 35 inside the guide face 36 is composed of a semi-cylindrical space. The guide face 36 is configured to have a radius of curvature slightly larger than the outer radius (R2) of the constant radius portion 24; in an exemplary embodiment, the radius of curvature is 1 mm larger than the outer radius R2.

The support base 37 has a height higher than the joining piece 31, and is provided with a circular support face 38 on a top face thereof. The support base 37 has a screw hole 39 formed along the height direction z. The screw hole 39 is formed in the center of the support face 38, and has an internal screw thread formed therein.

The screw 100 may be any type of threaded screw known to those with ordinary skill in the art.

The assembly of the electrical connector assembly 1 will now be described in greater detail.

In order to attach the electrical connector 10 to the holder 30, the electrical connector 10 is aligned with the holder 30 so that the attachment blocks 20 of the electrical connector 10 can be inserted into the housing chambers 35. Next, the attachment blocks 20 are inserted into the housing chambers 35. The guide face 36 guides the electrical connector 10 during insertion into the holder 30 in such a manner that the guide face 21 of the attachment block 20 slides on the guide face 36. The electrical connector 10 is pushed in until the bottom faces of the attachment blocks 20 abut the circular support faces 38 of the support bases 37, as shown in FIG. 1. The joining piece 31 also contacts the electrical connector 10 from below to support the electrical connector 10 while simultaneously holding the pair of housing towers 33. The tower main body 34 has a dimension in the height direction z approximately equal to the attachment block 20, so that the attachment block 20 is completely housed within the tower main body 34.

When the attachment block 20 is housed in a desired position in the housing chamber 35 and the electrical connector 10 is completely pushed in, the center of the insertion hole 28 of the attachment block 20 matches with the center of the screw hole 39 of the support base 37. The screws 100 are inserted through the insertion holes 28 of the attachment blocks 20 in the height direction z, and are fastened by engaging the threaded screw holes 39. The electrical connector 10 is thus fixed to the holder 30.

In the assembled electrical connector assembly 1, the contact (not shown) may be electrically connected to a mating contact of a mating connector in the mating recess 14, and electrically connected to another electrical device, for example, a circuit board, in lead-out recess 15.

Figure 7A:
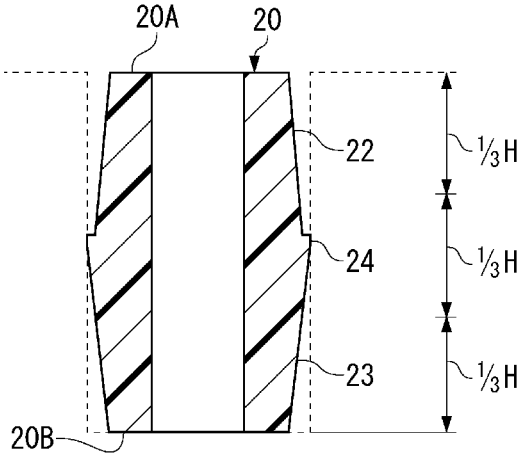
FIG. 7(*a*) is a sectional view of the attachment block of FIG. 4(*a*) and a housing tower of the holder of FIG. 6.
Figure 7B:
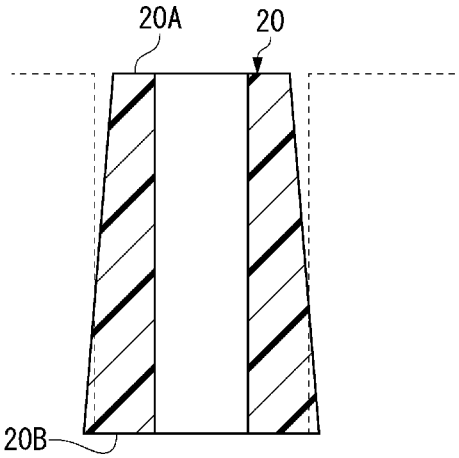
Figure 7C:
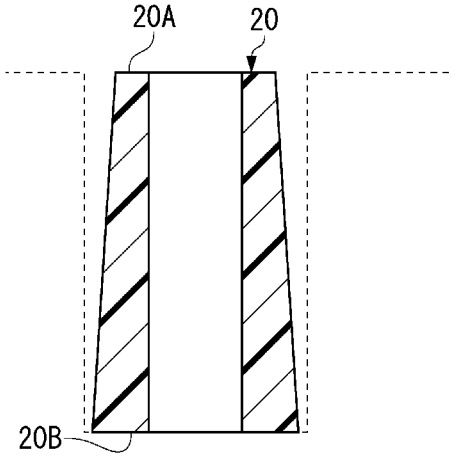

In another embodiment, the first truncated conical portion 22 and the second truncated conical portion 23 may be joined in a position shifted from the central portion 20C, but still within a central one-third region shown in FIG. 7(*a*).

In another embodiment, another member, for example, a circuit board, may be interposed between the attachment block 20 and the screw 100. This circuit board may be electrically connected to the contact (not shown) of the electrical connector 10.

The advantageous effects of the electrical connector assembly 1 will now be described in greater detail.

First, since the attachment block 20 projects more radially in central portion 20C than the first truncated conical portion 22 and the second truncated conical portion 23, the outline of the attachment block 20 can be visually confirmed when seen in a plan view. Therefore, when the attachment block 20 is located in the housing chamber 35, the attachment block 20 location with respect to the holder 30 can be confirmed with high accuracy.

Second, since the constant radius portion 24 is provided, as shown in FIG. 5(*a*), 5(*b*), the position of the parting plane 203 between the upper mold 201 and the lower mold 202 can be shifted from alignment with the step 25. In injection molding, a burr unavoidably occurs in the mold parting plane 203. However, due to this mold, a burr occurs in a position shifted from the step 25 that serves as a position reference, and visibility remains clear.

Third, since a portion having a maximum radius is provided in the central portion 20C, the wall thickness in the radial direction can be optimal along the attachment block 20. In an embodiment shown in FIGS. 7(*b*) and 7(*c*), the radius linearly increases from the one end 20A toward the other end 20B. However, in this case, as shown in FIG. 7(*b*), securing a necessary wall thickness in the end 20A causes a wall thickness in the end 20B to be too thick, and consequently the attachment block 20 cannot be housed in the housing chamber 35. In contrast, as shown in FIG. 7(*c*), limiting a wall thickness in the end 20B by a necessary amount causes a wall thickness in the end 20A to be too thin, and consequently, the attachment block 20 may not have the strength to resist fastening of the screw 100. When a portion having a maximum radius is provided in the central portion 20C, the attachment block 20 has a maximum strength and can be reliably housed in the housing chamber 35.

What is claimed is:

1. An electrical connector, comprising:

a housing; and an attachment block disposed on the housing and having a first end, an opposite second end, a first truncated conical portion having an outer radius continuously increasing from the first end toward the second end, a second truncated conical portion having an outer radius continuously increasing from the second end toward the first end, and a constant radius portion having a first side connected to the first truncated conical portion and a second side connected to the second truncated conical portion, a step disposed between the constant radius portion and the first or second truncated conical portion on only one of the first side and the second side of the constant radius portion.

2. The electrical connector of claim 1, wherein the housing is made of resin.

3. The electrical connector of claim 2, wherein the attachment block is made of resin.

4. The electrical connector of claim 1, wherein the housing and the attachment block are integrally formed.

5. The electrical connector of claim 1, further comprising a plurality of contacts disposed in the housing.

6. The electrical connector of claim 1, wherein the first truncated conical portion is connected to the second truncated conical portion centrally in a height direction of the attachment block.

7. The electrical connector of claim 6, wherein the constant radius portion has a constant radius in the height direction of the attachment block.

8. The electrical connector of claim 7, wherein a first maximum outer radius of the first truncated conical portion is less than a second maximum outer radius of the second truncated conical portion.

9. The electrical connector of claim 8, wherein the constant radius is equal to the second maximum outer radius.

10. The electrical connector of claim 9, wherein the constant radius portion is continuous to a portion of the second truncated conical portion having the second maximum outer radius.

11. The electrical connector of claim 10, wherein the constant radius portion is offset by the step from a portion of the first truncated conical portion having the first maximum outer radius.

12. The electrical connector of claim 1, wherein a plurality of attachment blocks are disposed on the housing.

13. An electrical connector assembly, comprising:

an electrical connector including a housing and an attachment block disposed on the housing, the attachment block having a first end, an opposite second end, a first truncated conical portion having an outer radius continuously increasing from the first end toward the second end, a second truncated conical portion having an outer radius continuously increasing from the second end toward the first end, and a constant radius portion having a first side connected to the first truncated conical portion and a second side connected to the second truncated conical portion, a step disposed between the constant radius portion and the first or second truncated conical portion on only one of the first side and the second side of the constant radius portion; and a holder including a cylindrical housing chamber in which the attachment block is disposed.

14. The electrical connector assembly of claim 13, wherein a screw extends through the attachment block and engages with the holder.

* * * * *